US010234149B2

(12) United States Patent
Alford

(10) Patent No.: US 10,234,149 B2
(45) Date of Patent: Mar. 19, 2019

(54) HVAC SYSTEMS HAVING IMPROVED FOUR-WAY VALVE REHEAT CONTROL

(71) Applicant: Lennox Industries Inc., Richardson, TX (US)

(72) Inventor: Malcolm Lloyd Alford, Coppell, TX (US)

(73) Assignee: Lennox Industries Inc., Richardson, TX (US)

( * ) Notice: Subject to any disclaimer, the term of this patent is extended or adjusted under 35 U.S.C. 154(b) by 302 days.

(21) Appl. No.: 15/197,735

(22) Filed: Jun. 29, 2016

(65) Prior Publication Data

US 2018/0003400 A1 Jan. 4, 2018

(51) Int. Cl.

| | |
|---|---|
| ***F24F 3/153*** | (2006.01) |
| ***F25B 41/04*** | (2006.01) |
| ***F24F 1/00*** | (2011.01) |
| ***F24F 13/30*** | (2006.01) |
| *F24F 1/0003* | (2019.01) |

(52) U.S. Cl.

CPC ..... *F24F 3/153* (2013.01); *F25B 41/04* (2013.01); *F24F 1/0003* (2013.01); *F24F 13/30* (2013.01)

(58) Field of Classification Search

CPC ..... F24F 3/153; F24F 1/0003; F24F 13/30; F25B 41/04; F25B 2313/02792; F25B 2313/0292; F25B 41/046; F25B 41/06; F25B 2313/02741; F16K 31/52491; F16K 11/027; F16K 11/065; F16K 11/22

See application file for complete search history.

(56) References Cited

U.S. PATENT DOCUMENTS

| | | | | |
|---|---|---|---|---|
| 2,974,682 | A | 3/1961 | Allen | |
| 4,255,939 | A | 3/1981 | Ou | |
| 4,869,073 | A * | 9/1989 | Kawai | F25B 13/00 62/160 |
| 5,953,926 | A | 9/1999 | Dressler et al. | |
| 6,644,049 | B2 | 11/2003 | Alford | |
| 2011/0088427 | A1* | 4/2011 | Ishii | F16K 11/0655 62/529 |
| 2012/0012536 | A1* | 1/2012 | Klochkoff | B01F 3/0446 210/748.1 |
| 2013/0089445 | A1* | 4/2013 | Ishikawa | F04B 27/109 417/559 |
| 2018/0003400 | A1* | 1/2018 | Alford | F24F 3/153 |

OTHER PUBLICATIONS

Lennox, "Humiditrol Whole-Home Dehumidification System," Sep. 2015, 4 pages.

* cited by examiner

*Primary Examiner* — Frantz Jules
*Assistant Examiner* — Steve Tanenbaum
(74) *Attorney, Agent, or Firm* — Hubbard Johnston, PLLC

(57) ABSTRACT

In one instance, a heating, ventilating, and air conditioning (HVAC) system includes a four-way reheat valve and is configured to accesses pressures within a conduit network to facilitate control of the reheat valve. The four-way reheat valve includes a piston valve slide within a main valve chamber and a pilot valve fluidly coupled to the main valve chamber and a compressor-suction conduit fluidly coupled to the four-way valve and to a compressor. The system also includes a flow-restricting device disposed on the conduit downstream of the four-way valve and a pilot conduit coupled to the conduit downstream of the flow-restricting device and coupled to the pilot valve for assisting with movement of the piston valve slide.

20 Claims, 7 Drawing Sheets

HVAC SYSTEMS HAVING IMPROVED FOUR-WAY VALVE REHEAT CONTROL

TECHNICAL FIELD

This application is directed to heating, ventilating, and air conditioning (HVAC) systems having an improved four-way valve for selectively activating a reheat portion.

BACKGROUND

Heating, ventilating, and air conditioning (HVAC) systems can be used to regulate the environment within a conditioned space. Typically, an air blower is used to pull air (i.e., return air) from the conditioned space into the HVAC system through ducts and push the air into the conditioned space through additional ducts after conditioning the air (e.g., heating, cooling, or dehumidifying the air). The dehumidifying aspect of an HVAC system may utilize a moisture-altering device or devices.

In a cooling system in which a dehumidifier is desired, the air to be conditioned may be cooled adequately to dehumidify the air and if in a cooling mode can simply provide the resultant airstream to the space to be conditioned. When not in a cool mode, it is necessary to cool the air adequately to dehumidify the air, but then heat it again to a desired temperature range. This may be accomplished using a reheat coil that uses heat from the compressor. To selectively control the flow of the refrigerant to the reheat coil before going to the condenser, a solenoid valve has been used and later other valves, such as a heat-pump valve as shown in FIG. 1.

FIG. 1 presents an HVAC system 100 having a selectively operable reheat device 102 that is coupled to a valve 104 by a pipe 106. The reheat device 102 is also coupled by pipe 108 and pipe 109 to a condenser 110. The pipe 108 may include a one-way valve 112. The condenser 110 is coupled by pipe 114 to an evaporator 116, which has an expansion valve 118 associated with it. The evaporator 116 is coupled by pipe 120 in cooperation with pipe 122 to compressor 124 at a suction portion 125 and by pipe 120 to valve 104. A portion of pipe 120 includes an orifice 126 that is downstream of a guide pipe 128 that is coupled to a guide valve 130. A pipe 132 is coupled to a discharge port 134 of the compressor 124 and to the valve 104. Another guide pipe 136 couples pipe 132 to the guide valve 130. The guide valve 130 is also coupled by guide pipes 138 and 140 to the valve 104, which may be a heat-pump valve. In operation, air is pulled across the evaporator 116 for sufficient cooling to dehumidify the air and then the cooled air is passed by the reheat device 102, which is off if in the cooling mode and is on if in the reheat mode.

While this and other techniques have been used to incorporate reheat features into HVAC systems, improvements in performance and or cost of equipment remain desirable.

SUMMARY

According to one illustrative embodiment, a heating, ventilating, and air conditioning system includes a four-way reheat valve having a piston valve slide within a main valve chamber and a pilot valve fluidly coupled to the main valve chamber and a compressor-suction conduit fluidly coupled to the four-way valve and to a compressor. The system also includes a flow-restricting device disposed on the conduit downstream of the four-way valve and a pilot conduit coupled to the conduit downstream of the flow-restricting device and coupled to the pilot valve for assisting with movement of the piston valve slide.

According to another illustrative embodiment, a heating, ventilating, and air conditioning system includes a plurality of conduits forming a closed network containing a working fluid, a condenser coil fluidly coupled to the plurality of conduits and forming a portion of the closed network, the condenser coil for cooling the working fluid, and an evaporator coil fluidly coupled to the plurality of conduits and forming a portion of the closed network. The evaporator coil is configured to cool an air flow to be conditioned and produce a first conditioned air flow. The system further includes an expansion device fluidly coupled to the plurality of conduits and forming a portion of the closed network and positioned between the evaporator coil and the condenser with respect to the flow of the working fluid in the closed network, the expansion device for expanding the working fluid and cooling the evaporator coil and a compressor fluidly coupled to the plurality of conduits and forming a portion of the closed network and positioned downstream of the evaporator coil with respect to the flow of the working fluid in the closed network. The system also has a four-way reheat valve fluidly coupled to the plurality of conduits and forming a portion of the closed network and positioned between the compressor and the condenser with respect to the flow of the working fluid in the closed network and also includes a reheat coil fluidly coupled to the plurality of conduits and forming a portion of the closed network, the reheat coil receiving the first conditioned air flow and selectively producing a second conditioned air flow, the reheat coil fluidly coupled with respect to the working fluid in the closed network to the four-way reheat valve.

The four-way reheat valve of the preceding paragraph includes a valve body having a main valve chamber, a first conduit coupled to the valve body fluidly coupled to the compressor for receiving working fluid from the compressor, a second conduit coupled to the valve body and fluidly coupled to the condenser for discharging a working fluid at least partially to the condenser, a third conduit coupled to the valve body and fluidly coupled to a suction port of the compressor, the third conduit for fluidly coupling with the compressor, and a fourth conduit coupled to the valve body and fluidly coupled to the reheat coil. The four-way reheat valve further includes a piston valve slide member disposed within the main valve chamber and slideable between a first position and a second position, wherein the first position, which is a cooling position, fluidly couples the first conduit and the second conduit and fluidly couples the third conduit and fourth conduit, and wherein the second position, which is a reheat position, fluidly couples the first conduit and the fourth conduit and fluidly couples the second conduit and the third conduit, and a pilot valve fluidly coupled by a first pilot conduit to the first conduit upstream of the valve body, the pilot valve fluidly coupled by a second pilot conduit to a portion of the valve chamber proximate a first end of the main valve chamber, the pilot valve fluidly coupled by a third pilot conduit to a second end of the main valve chamber, and the pilot valve fluidly coupled by a fourth pilot conduit to the third conduit downstream of the valve body. The system also includes an orifice coupled within the third conduit downstream of the valve body and upstream of a location where the fourth pilot conduit is coupled to the third conduit.

According to still another illustrative embodiment, a method of controlling flow in a heating, ventilating, and air conditioning system includes providing a compressor, a reheat coil, and a condenser all fluidly coupled to a closed network having a working fluid. The method also involves providing a four-way valve fluidly coupled to the closed network, wherein the four-way valve comprises a piston valve slide within a main valve chamber and further comprises a pilot valve fluidly coupled to the main valve chamber for assisting with moving the piston valve slide within the main valve chamber of the four-way valve and extracting fluid from a conduit downstream of the four-way valve and downstream of a flow-restricting device. Further still, the method includes providing the fluid to the pilot valve to assist with operating the four-way valve, wherein the fluid has a lower pressure than fluid upstream of the flow-restricting device. Other embodiments and designs are presented further below.

BRIEF DESCRIPTION

Reference is now made to the following descriptions taken in conjunction with the accompanying drawings, in which.

DETAILED DESCRIPTION

Figure 1:
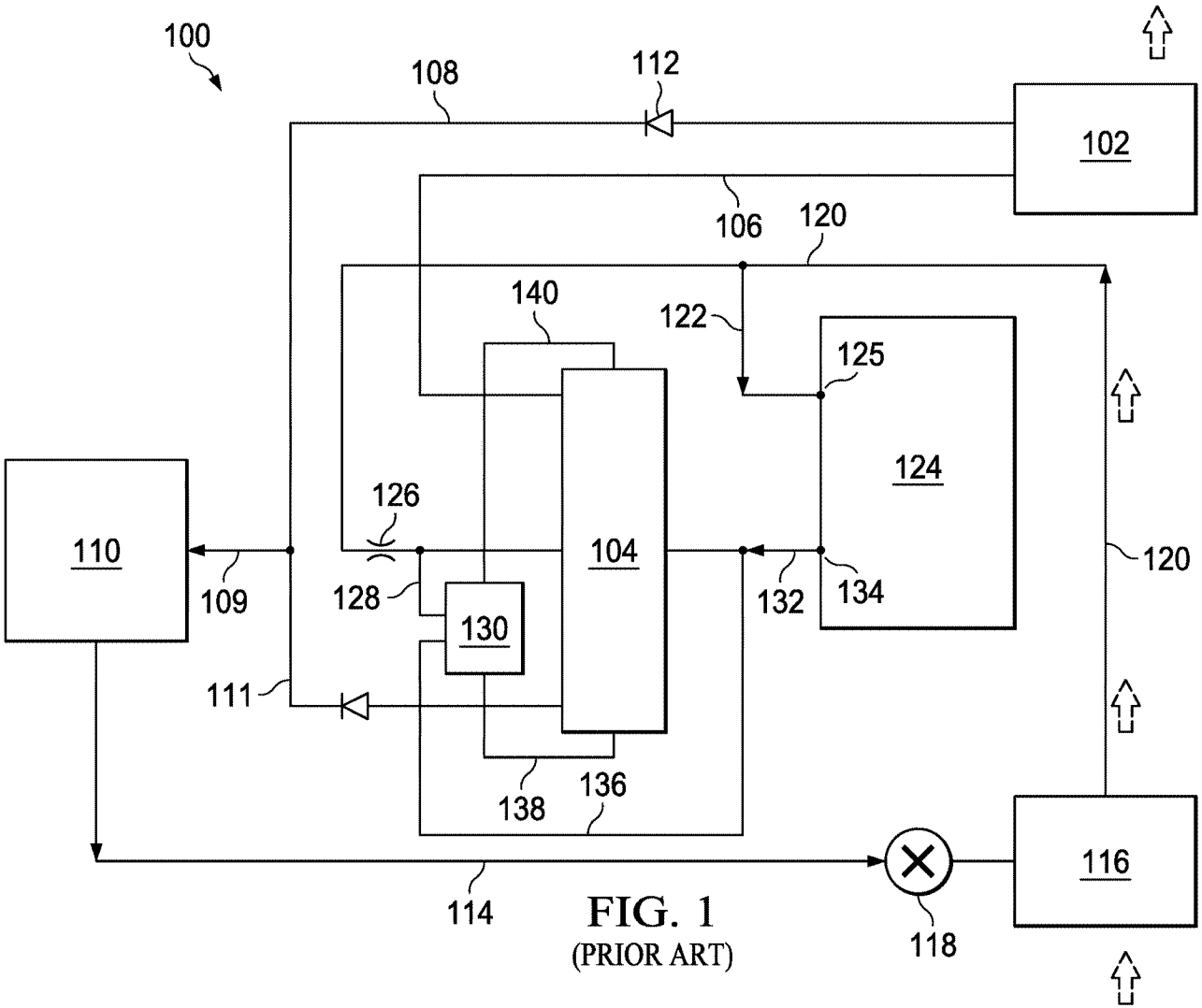
FIG. 1 (PRIOR ART)
FIG. 1 is a schematic diagram of a prior art HVAC system having a reheat device.
Figure 2:
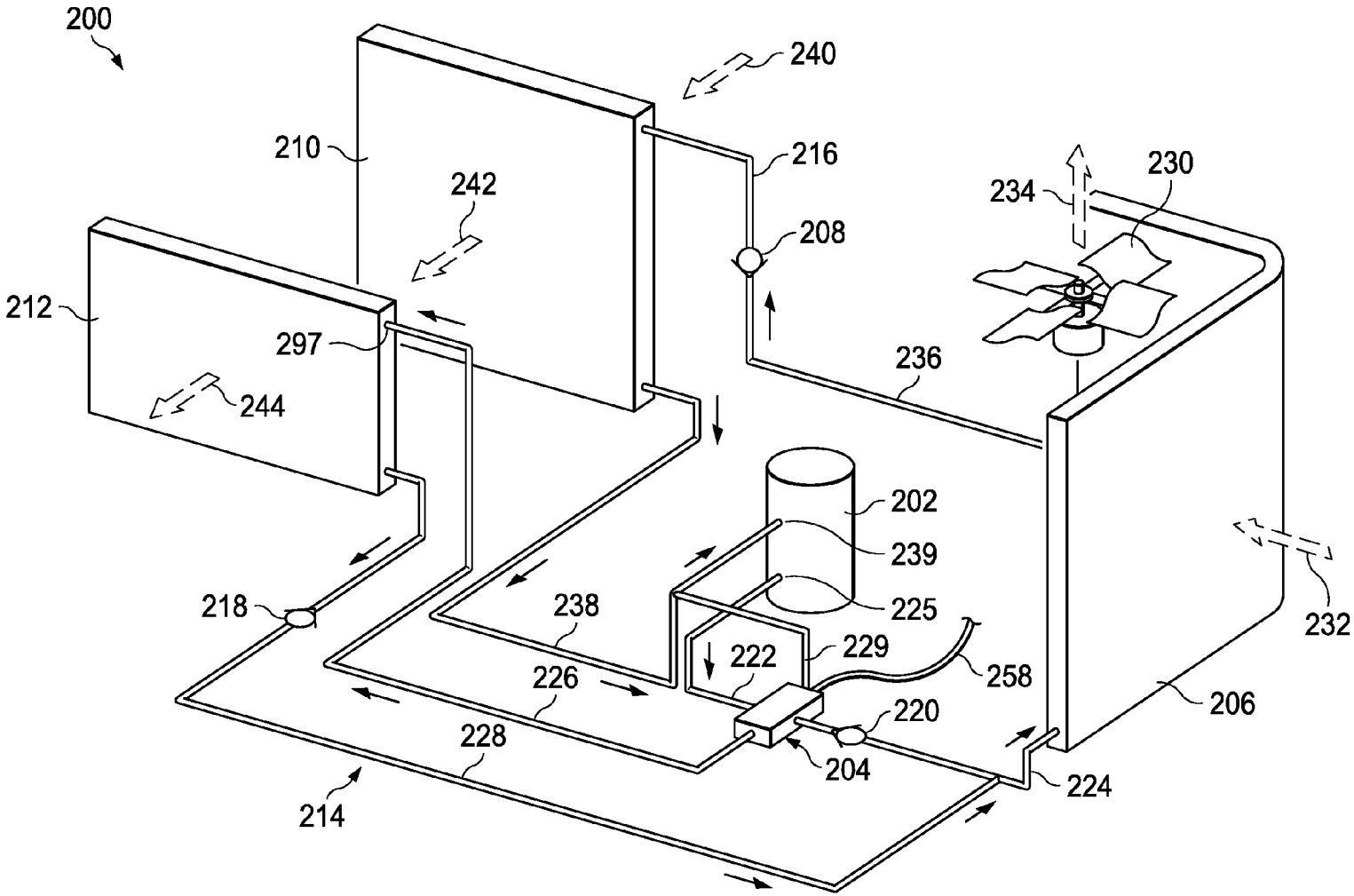
FIG. 2 is a schematic diagram of an HVAC system with an improved four-way valve reheat control according to one illustrative embodiment.

Referring now to FIG. 2, a schematic diagram of an illustrative embodiment of an heating, ventilating, and air conditioning (HVAC) system 200 having improved four-way valve reheat control is presented. The system 200 includes a compressor 202, a four-way reheat valve 204, a condenser coil 206, an expansion device 208, an evaporator coil 210, and a reheat coil 212, which are all fluidly coupled by a plurality of conduits 214 forming a closed network 216 containing a working fluid, or refrigerant. The system 200 may include one or more check valves, e.g., first check valve 218 and a second check valve 220. The system 200 involves the flow of two fluids: the working fluid and the air to be conditioned. Both will be presented.

With respect to the working fluid, the high-pressure working fluid is delivered from the compressor 202 through conduit 222 that exits a discharge port 225 and goes to four-way reheat valve 204. The working fluid then goes selectively as determined by the four-way reheat valve 204 to the condenser coil 206 through conduit 224 or through conduit 226 to the reheat coil 212. If fluid is delivered through the reheat coil 212 it is then delivered through conduit 228 to conduit 224. The check valve 220, which is fluidly coupled to the second conduit 250 (FIG. 4) between the four-way valve 204 and the reheat coil 212, may be used to prevent flow back to the four-way reheat valve 204. If the reheat coil 212 is not in use, a conduit 229 may be used to remove working fluid from the reheat coil 212 and provide it to the compressor 202.

The working fluid is cooled in the condenser coil 206. A condenser fan 230 may be used to pull outdoor air 232 through the condenser and discharging it as shown by numeral 234. The working fluid is delivered from the condenser coil 206 by conduit 236 and through the expansion device 208 to evaporator coil 210. The expansion device 208 and evaporator coil 210 provide cooling to an airstream as will be described further below resulting in a low pressure working fluid that is delivered by conduit 238 to the compressor 202. It will be clear that the plurality of conduits 214 in this embodiment includes conduits 222, 224, 226, 228, 236, and 238, which form aspects of the closed network 216.

With respect to the air to be conditioned, the air returning from the space to be conditioned or from outside 240 is forced by blower or other device across the evaporator coil 210 to produce a first conditioned airstream 242. The first conditioned airstream 242 may be cooled sufficiently to remove moisture from the air and thereby dehumidify the air. The first conditioned airstream 242 is then forced across the reheat coil 212 to produce a second conditioned airstream 244. If the system 200 is in cooling mode, the reheat coil 212 is not receiving flowing working fluid from the four-way valve 204 and the second conditioned airstream 244 may be the same or substantially the same as the first conditioned airstream 242. If, however, the system 200 is in reheat mode, working fluid is flowing in the reheat coil 212 and the first conditioned airstream 242 is heated as it flows through the reheat coil 212 to produce the second conditioned airstream 244 that is warmer—as desired—than the first conditioned airstream 242.

Figure 3A:
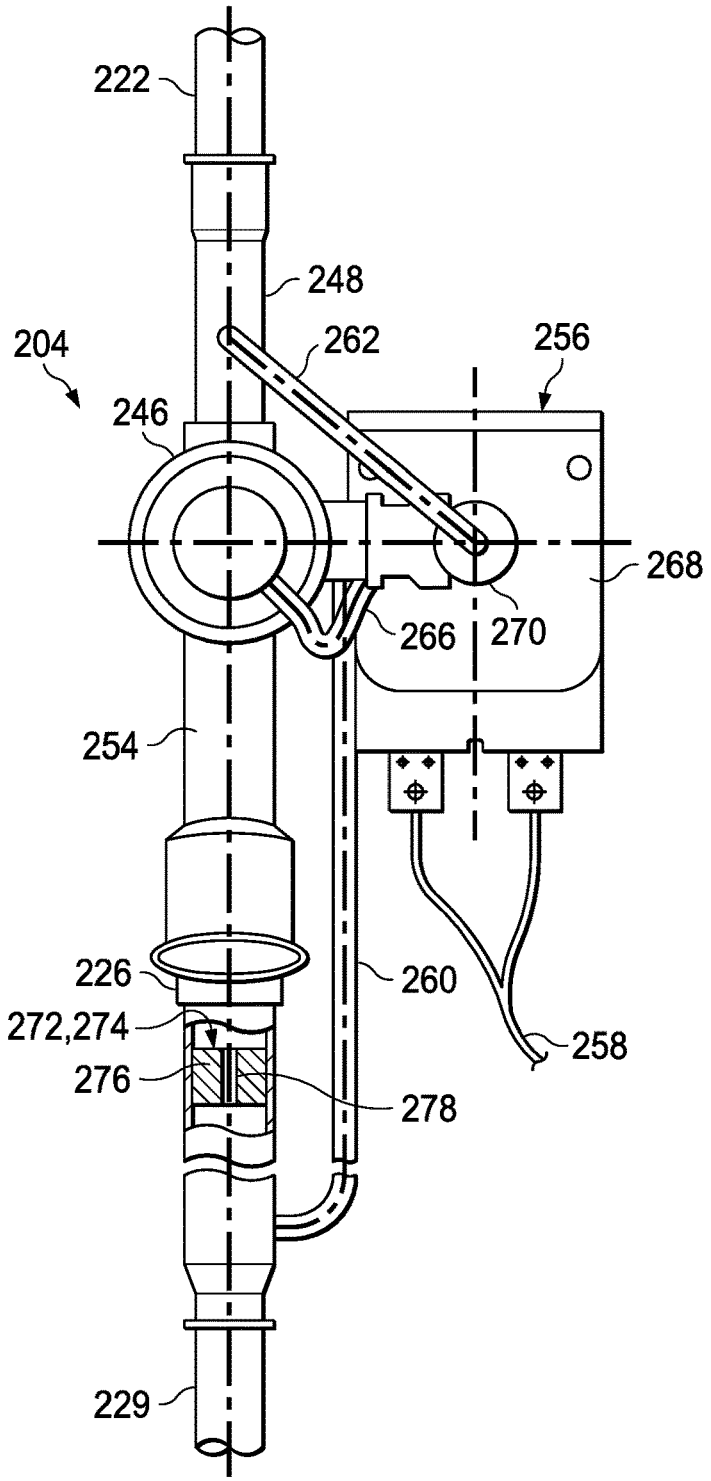
FIG. 3A is a schematic side elevation view of an illustrative embodiment of an improved four-way valve for uses as an aspect of the HVAC system of FIG. 2.
Figure 3B:
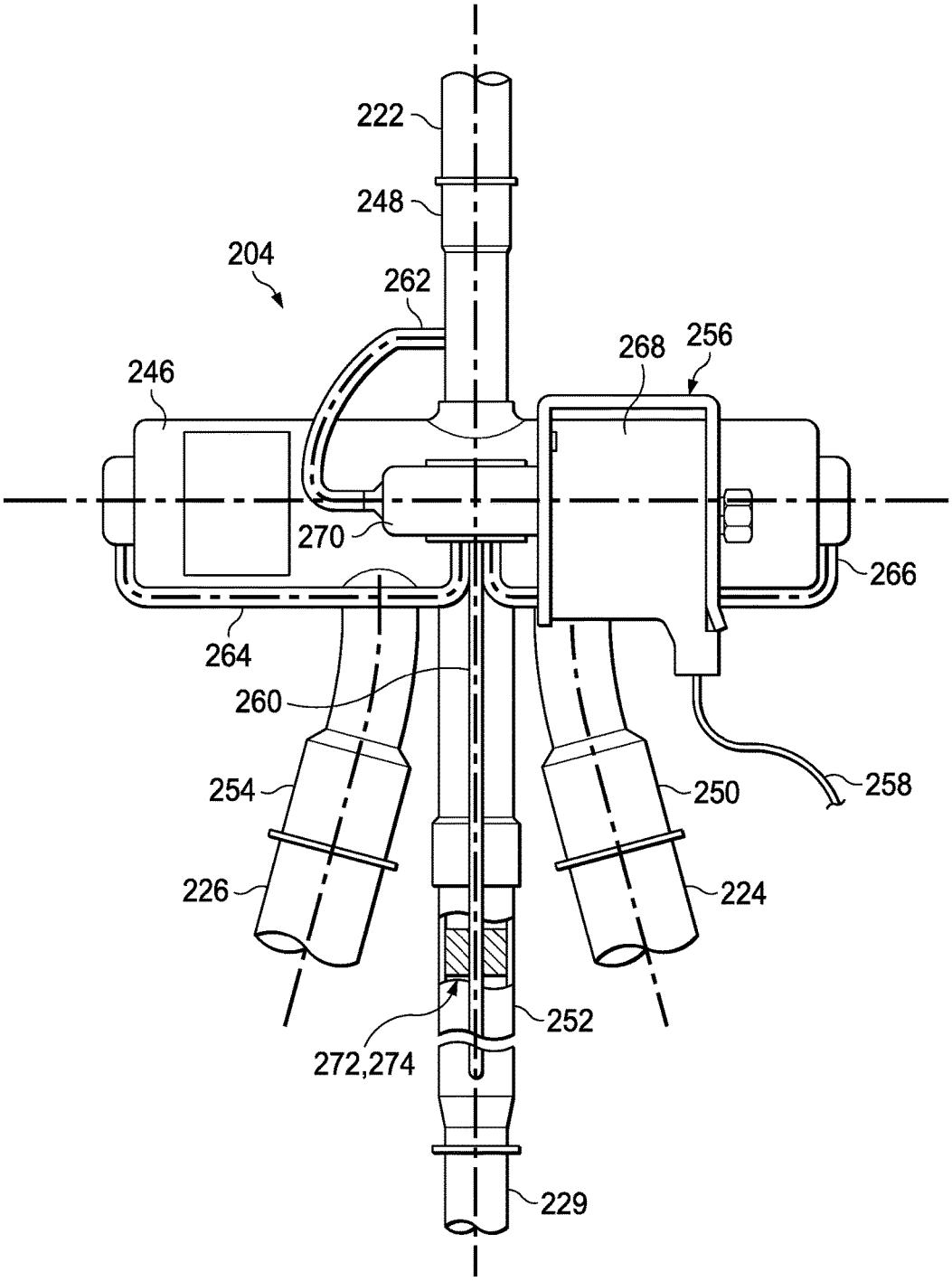
FIG. 3B is a schematic front elevation view of the improved four-way valve of FIG. 3A.

Turning now to the four-way reheat valve 204, additional information will be presented. The four-way reheat valve 204 may be of type used in a different application for heat-pump reversing that has been modified to include a flow-restricting device 272, e.g., an orifice 274, as shown and described herein. Referring now to primarily to FIGS. 3A and 3B, the four-way reheat valve 204 that has the ability to have fluid communication with four conduits: conduits 222, 224, 226, and 229. The four-way reheat valve 204 has a valve body 246. The valve body 246 has a main valve chamber with a piston valve slide as will be described in one illustrative embodiment in connection with FIG. 4. The four-way reheat valve 204 includes a first conduit 248 coupled to the valve body 246 fluidly coupled to the compressor 202 (FIG. 2) for receiving working fluid from the compressor 202 and a second conduit 250 coupled to the valve body 246 and fluidly coupled to the condenser 206 (FIG. 2) for discharging a working fluid at least partially to the condenser 206 (FIG. 2). The four-way reheat valve 204 also includes a third conduit 252 coupled to the valve body 246 and fluidly coupled to a suction port 239 of the compressor 202 (FIG. 2). The third conduit 252 is coupled to the valve body 246 and is for fluidly coupling with the compressor 202. The four-way reheat valve 204 also includes a fourth conduit 254 coupled to the valve body 246 and fluidly coupled to the reheat coil 212.

The four-way reheat valve 204 also includes a pilot valve 256 that receive a control signal or input by way of communication line or power line 258. The pilot valve 256 has a plurality of pilot conduits that provide fluid communication to locations within a main valve chamber (see, FIG. 4) within the valve body 246. The plurality of pilot conduits includes pilot conduits 260, 262, 264, and 266. The illustrative embodiment of pilot valve 256 includes an actuator 268 (FIGS. 3A and 3B) and a valve portion 270 (FIGS. 3A and 3B). As will be explained further below in connection with FIG. 4, the pilot conduits assist with moving a piston valve slide member.

A flow-restricting device 272, e.g., an orifice 274, is disposed within a portion of the third conduit 252. The orifice 274 includes an orifice plate 276 having an aperture 278 therethrough. In one illustrative, non-limiting embodiment, the aperture 278 is less than 1/16 of an inch in diameter, but other dimension are possible as desired. Note that the pilot conduit 260 is fluidly coupled to the third conduit 252 downstream of the valve body 246 and downstream of the flow-restricting device 272. A reduced pressure is realized this way in the pilot conduit 260 that is lower (more reduced) than would otherwise be experienced if the pilot conduit 260 were fluidly coupled to the third conduit 252 upstream of the flow-restricting device 272. This in turn makes operation of the four-way reheat valve 204 easier. The valve 204 has a minimum specified differential pressure measured between pilot conduit 262 and 260 that guarantees the valve will shift properly. The reduced pressure realized at pilot conduit 260 increases this differential pressure, therefore assuring the operation of the valve 204.

Figure 4:
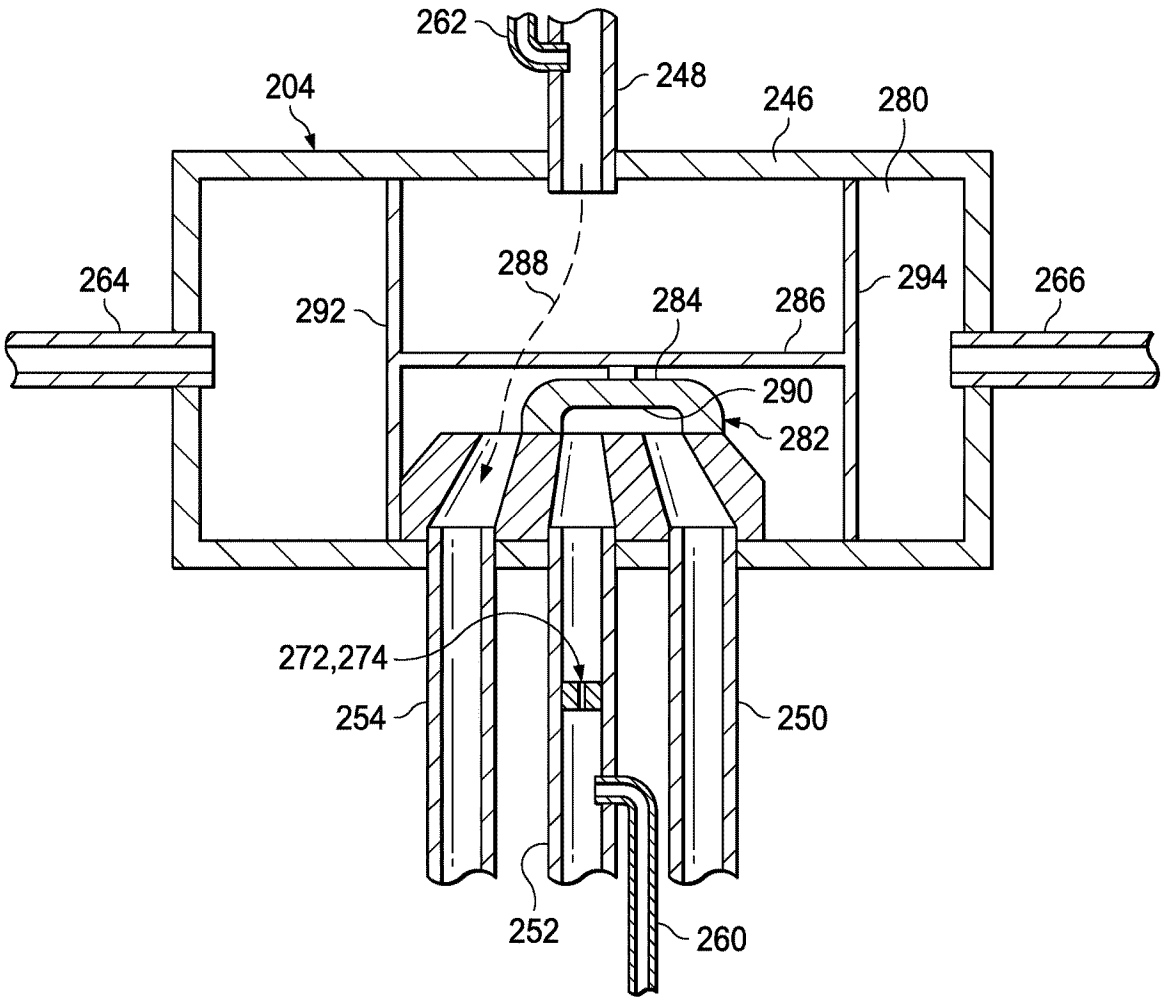
FIG. 4 is a schematic cross section of the improved four-way valve for use with the system of FIG. 2.

Referring now to FIG. 4, a schematic, illustrative embodiment of a portion of the four-way reheat valve 204 is presented (the pilot valve 256 is not shown). The four-way reheat valve 204 includes the valve body 246 that is formed with a main valve chamber 280. Disposed within the main valve chamber is a piston valve slide member 282. In this illustrative embodiment for demonstration purposes, the piston valve slide member 282 includes a conduit connector portion 284 and a piston portion 286. The piston valve slide member 282 is slideable between a first position and a second position. The first position (not explicitly shown) is a cooling position that fluidly couples the first conduit 248 and the second conduit 250 and fluidly couples the third conduit 252 and fourth conduit 254. The second position (which is shown) is a reheat position that fluidly couples the first conduit 248 and the fourth conduit 254 as suggested by flow path 288 and fluidly couples the second conduit 250 and the third conduit 252 by way of a flow-coupling portion 290 of the conduit connector 284 of the piston valve slide member 282.

In moving to the piston valve slide member 282 within the main valve chamber 280 to the position shown in FIG. 4, a pressure is applied to a first portion 292 of the piston 286 while a relatively reduced pressure is applied to a second portion 294 of the piston 286. By locating the pilot conduit 260 connection to the third conduit 252 downstream of the flow-restricting device 272, a stronger reduced pressure (less pressure) is more readily obtained to apply to the second portion 294 of the piston 286 than would be possible if the pilot conduit 260 connection to the third conduit 252 was upstream of the flow-restricting device 272. Similarly, in moving to the piston valve slide member 282 within the main valve chamber 280 to the cooling position, a pressure would be applied to the second portion 294 of the piston 286 while a relatively reduced pressure is applied to the first portion 292 of the piston 286. The pilot valve facilitates the movement of the piston 286 to control the 4-way reheat valve 204.

Figure 5:
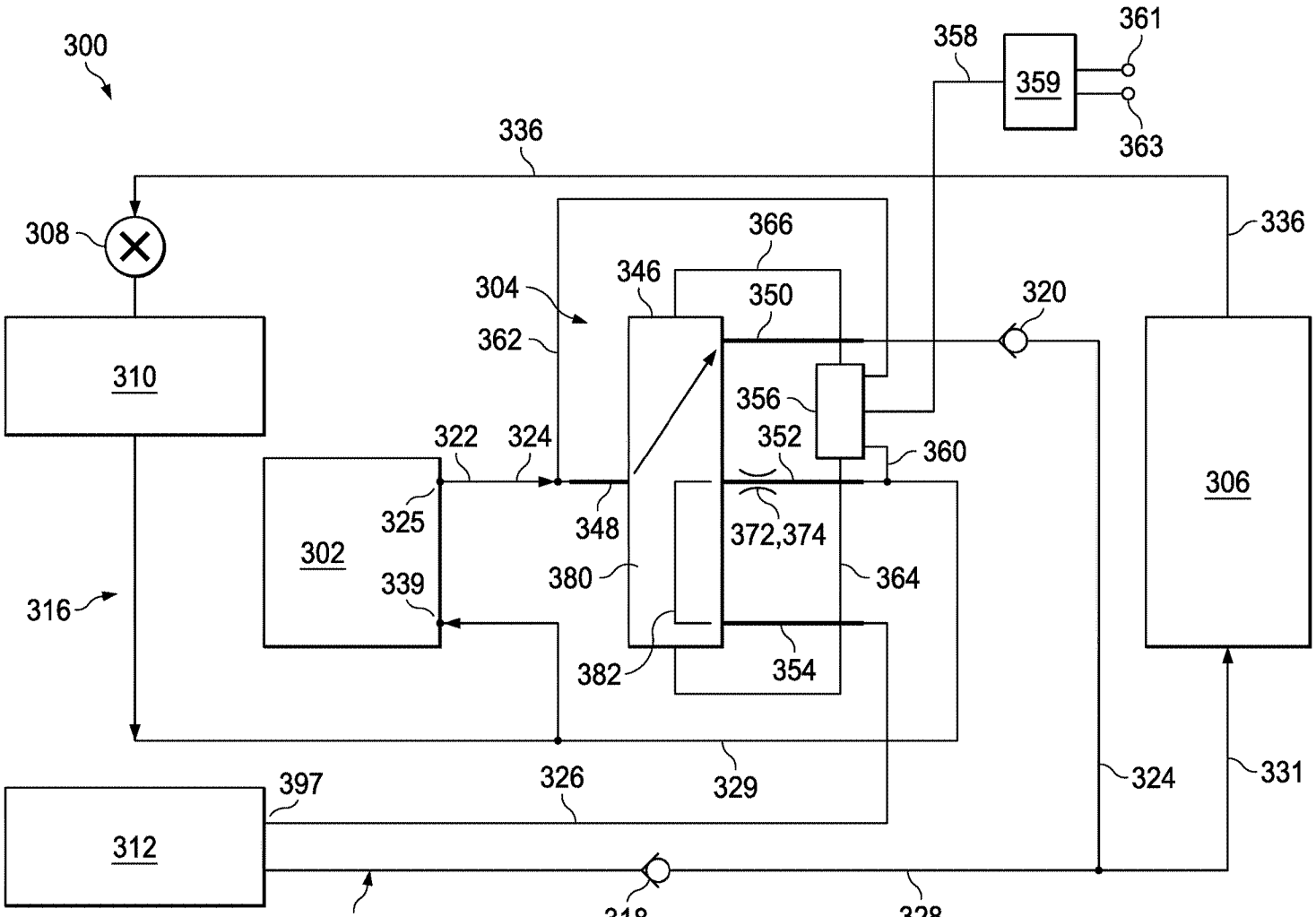
FIG. 5 is a schematic diagram of an HVAC system with an improved four-way valve reheat control according to one illustrative embodiment shown in a cooling mode.
Figure 6:
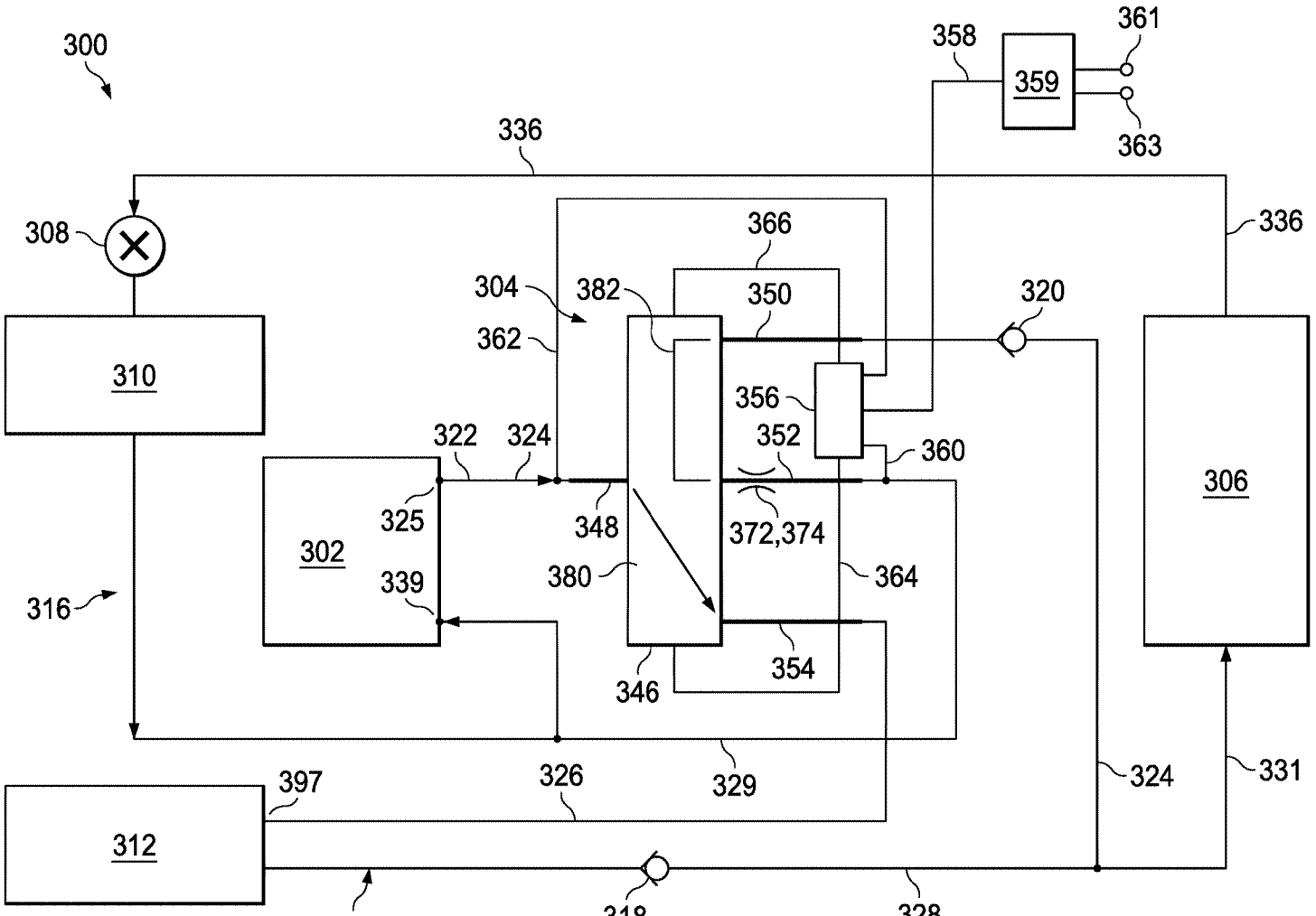
FIG. 6 is a schematic diagram of the HVAC system with an improved four-way valve reheat control of FIG. 5 shown in a reheat mode.

Referring now to FIGS. 5 and 6, another illustrative embodiment of an HVAC system 300 is presented. FIG. 5 shows the system 300 in cooling mode and FIG. 6 is the system in a reheat mode. The system is analogous to those previously presented, and analogous parts have reference numerals that have been indexed by 100. Accordingly, some parts are labeled but not further described here. In addition, components referenced but not explicitly shown are analogous to those previously presented.

The system 300 includes a compressor 302, a four-way reheat valve 304, a condenser coil 306, an expansion device 308, an evaporator coil 310, and a reheat coil 312, which are all fluidly coupled by a plurality of conduits 314 forming a closed network 316 containing a working fluid, or refrigerant. The system 300 may include one or more check valves, e.g., first check valve 318 and a second check valve 320.

With respect to the closed network 316, a high-pressure (relatively) working fluid is discharged by the compressor 302 through a discharge port 325 and travels through conduit 322 to the four-way reheat valve 304. The four-way reheat valve 304 delivers the working fluid to the condenser coil 306 by way of conduit 324 in cooling mode or to the reheat coil 312 by way conduit 326 in reheat mode. When in the cooling mode (FIG. 5), the four-way reheat valve 304 fluidly couples conduit 326 and conduit 329 so as to pull working fluid from the reheat coil 312 and deliver it along with working fluid from the evaporator coil 310 to a suction port 339 of the compressor 302. At the same time, a second check valve 318, which is fluidly coupled to the second conduit 350 on conduit 328 between the four-way valve 304 and the reheat coil 312, prevents fluid from being pulled into the reheat coil 312 from the majority of conduit 328.

When in the reheat mode (FIG. 6), working fluid is delivered from the four-way reheat valve 304 through conduit 326 to the reheat coil where the working fluid provides heat for an airstream (see 244 in FIG. 2) and then is delivered by conduit 328 (and a small portion of conduit 324 or what could be deemed another conduit 331 to the condenser coil 306. In either reheat or cooling mode, the working fluid is delivered from the condenser coil 306 to the expansion device 308 and evaporator coil 310 by conduit 336. The working fluid as expanded is used to cool an airstream (see 240 in FIG. 2) to produce a first conditioned airstream (see 242, FIG. 2) before further conditioning of that airstream at the reheat coil to produce the second conditioned airstream (244 in FIG. 2).

The layout and operation of the four-way reheat valve 304 is analogous to that of the four-way reheat valve 204 of FIGS. 2-4. The four-way reheat valve 304 is presented and includes a pilot valve 356. The four-way reheat valve 304 includes the valve body 346 that is formed with a main valve chamber 380. Disposed within the main valve chamber 380 is a piston valve slide member 382. The piston valve slide member 382 is slideable between a first position (FIG. 5) and a second position (FIG. 6). The first position is a cooling position that fluidly couples the first conduit 348 and the second conduit 350 and fluidly couples the third conduit 352 and fourth conduit 354. The second position is a reheat position that fluidly couples the first conduit 348 and the fourth conduit 354 as suggested by flow path 388 and fluidly couples the second conduit 350 and the third conduit 352.

The pilot valve 356 receives a control signal or input by way of communication line or power line 358 from a controller 359. The controller 359 may receive inputs such as from a temperature transducer 361 or a humidity transducer 363. The control signal provides direction to the pilot valve 356, which in turn controls the fluid coupling accomplished by the four-way valve 304 as between the first position and second position. The controller 359 is for providing a control signal to the pilot valve 356 to move the piston valve slide 382 between the first position and the second position based at least in part on humidity within a space to be conditioned. Locating the flow-restricting device 372, e.g., orifice 374, on the third conduit 352 downstream of the valve body 346 and upstream of where the pilot conduit 360 fluidly couples to the third conduit 352 provides for better operation of the four-way valve 304.

With reference to FIGS. 2-6, in one illustrative embodiment, an HVAC system 200, 300 includes a four-way valve 204, 304 having a piston valve slide 282, 382 within a main valve chamber 280, 380 and a pilot valve 256, 356 fluidly coupled to the main valve chamber 280, 380. The system includes a compressor-suction conduit 225, 325 fluidly coupled to the four-way valve 204, 304 and to a compressor 202, 302 and includes a flow-restricting device 272, 372 disposed on the conduit 229, 329 downstream of the four-way valve 204, 304; and a pilot conduit 260, 360 coupled to the conduit 229, 329 downstream of the flow-restricting device 272, 372 and coupled to the pilot valve 256, 356 for assisting with movement of the piston valve slide 282, 382.

The illustrative system 200, 300 of the previous paragraph may further include a compressor 202, 302; a compressor-discharge conduit 224, 324 fluidly coupled between a discharge port 225, 325 of the compressor 202, 302 and the four-way valve 204, 304; a condenser 206, 306; a condenser conduit 224, 324 fluidly coupled between the condenser 206, 306 and the four-way valve 204, 304; a compressor-suction conduit 229, 329 fluidly coupled between a suction port 239, 339 of the compressor 202, 302 and the four-way valve 204, 304; and a reheat-intake conduit 226, 326 fluidly coupled between the intake port 297, 397 of the re-heat coil and the four-way valve 204, 304.

According to an illustrative embodiment, a method of controlling flow in an HVAC system includes providing a compressor, a reheat coil, and a condenser all fluidly coupled to a closed network having a working fluid. The method also includes providing a four-way valve fluidly coupled to the closed network, wherein the four-way valve comprises a piston valve slide within a main valve chamber and further comprises a pilot valve fluidly coupled to the main valve chamber for assisting with moving the piston valve slide within the main valve chamber of the four-way valve. Further still, the method includes extracting fluid from a conduit downstream of the four-way valve and downstream of a flow-restricting device. Finally, the method also involves providing the fluid to the pilot valve to assist with operating the four-way valve, wherein the fluid has a lower pressure than fluid upstream of the flow-restricting device.

As used herein, the term "coupled" includes coupling via a separate object and includes direct coupling. The term "coupled" also encompasses two or more components that are continuous with one another by virtue of each of the components being formed from the same piece of material or associated one to another by a magnetic field. "Fluidly coupled" means having, at least at times in which flow is desired, fluid communication between the coupled items.

The present invention and its advantages have been disclosed in the context of certain illustrative, non-limiting embodiments. The illustrative descriptions above are not intended to be exhaustive or to limit the invention to the precise forms disclosed. Moreover, it should be understood that various changes, substitutions, permutations, and alterations can be made without departing from the scope of the invention as defined by the appended claims. It will be appreciated that any feature that is described in connection to any one embodiment may also be applicable to any other embodiment.

What is claimed is:

1. A heating, ventilating, and air conditioning system comprising:

a plurality of conduits forming a closed network containing a working fluid;

a condenser coil fluidly coupled to the plurality of conduits and forming a portion of the closed network, the condenser coil for cooling the working fluid;

an evaporator coil fluidly coupled to the plurality of conduits and forming a portion of the closed network;

wherein the evaporator coil is configured to cool an air flow to be conditioned and produce a first conditioned air flow;

an expansion device fluidly coupled to the plurality of conduits and forming a portion of the closed network and positioned between the evaporator coil and the condenser coil with respect to the flow of the working fluid in the closed network, the expansion device configured for expanding the working fluid;

a compressor fluidly coupled to the plurality of conduits and forming a portion of the closed network and positioned downstream of the evaporator coil with respect to the flow of the working fluid in the closed network;

a four-way reheat valve fluidly coupled to the plurality of conduits and forming a portion of the closed network and positioned between the compressor and the condenser coil with respect to the flow of the working fluid in the closed network;

a reheat coil fluidly coupled to the plurality of conduits and forming a portion of the closed network, the reheat coil receiving the first conditioned air flow and selectively producing a second conditioned air flow, the reheat coil fluidly coupled with respect to the working fluid in the closed network to the four-way reheat valve;

wherein the four-way reheat valve comprises:

a valve body having a main valve chamber, a first conduit coupled to the valve body fluidly coupled to the compressor for receiving working fluid from the compressor, a second conduit coupled to the valve body and fluidly coupled to the condenser coil for discharging a working fluid at least partially to the condenser coil, a third conduit coupled to the valve body and fluidly coupled to a suction port of the compressor, the third conduit for fluidly coupling with the compressor, a fourth conduit coupled to the valve body and fluidly coupled to the reheat coil, a piston valve slide member disposed within the main valve chamber and slideable between a first position and a second position, wherein the first position, which is a cooling position, fluidly couples the first conduit and the second conduit and fluidly couples the third conduit and fourth conduit, and wherein the second position, which is a reheat position, fluidly couples the first conduit and the fourth conduit and fluidly couples the second conduit and the third conduit, and a pilot valve fluidly coupled by a first pilot conduit to the first conduit upstream of the valve body, the pilot valve fluidly coupled by a second pilot conduit to a portion of the valve chamber proximate a first end of the main valve chamber, the pilot valve fluidly coupled by a third pilot conduit to a second end of the main valve chamber, and the pilot valve fluidly coupled by a fourth pilot conduit to the third conduit downstream of the valve body; and an orifice coupled within the third conduit downstream of the valve body and upstream of a location where the fourth pilot conduit is coupled to the third conduit.

2. The heating, ventilating, and air conditioning system of claim 1, wherein the four-way reheat valve comprises a heat-pump reversing valve.

3. The heating, ventilating, and air conditioning system of claim 1, wherein the orifice comprises an orifice plate having an orifice aperture that is less than 1/16 of an inch in diameter.

4. The heating, ventilating, and air conditioning system of claim 1, further comprising a plurality of check valves in the closed network.

5. The heating, ventilating, and air conditioning system of claim 1, further comprising a first check valve fluidly coupled to the second conduit between the four-way valve and the condenser coil.

6. The heating, ventilating, and air conditioning system of claim 1, further comprising a second check valve fluidly coupled to the second conduit between the four-way valve and the reheat coil.

7. The heating, ventilating, and air conditioning system of claim 1, further comprising a first check valve fluidly coupled to the second conduit between the four-way valve and the condenser coil and a second check valve fluidly coupled to the second conduit between the four-way valve and the reheat coil.

8. The heating, ventilating, and air conditioning system of claim 1, further comprising a controller for providing a control signal to the pilot valve to move the piston valve slide between the first position and the second position based at least in part on humidity within a space to be conditioned.

9. A heating, ventilating, and air conditioning system comprising:

a four-way reheat valve having a piston valve slide within a main valve chamber and a pilot valve fluidly coupled to the main valve chamber;

a compressor-suction conduit fluidly coupled to the four-way valve and to a compressor;

a flow-restricting device disposed on the compressor-suction conduit downstream of the four-way valve; and a pilot conduit coupled to the compressor-suction conduit downstream of the flow-restricting device and coupled to the pilot valve for assisting with movement of the piston valve slide.

10. The heating, ventilating, and air conditioning system of claim 9, further comprising:

a compressor;

a compressor-discharge conduit fluidly coupled between a discharge port of the compressor and the four-way valve;

a condenser;

a condenser conduit fluidly coupled between the condenser and the four-way valve;

a compressor-suction conduit fluidly coupled between a suction port of the compressor and the four-way valve; and a reheat-intake conduit fluidly coupled between the intake port of the re-heat coil and the four-way valve.

11. The heating, ventilating, and air conditioning system of claim 9, wherein the four-way reheat valve comprises a heat-pump reversing valve.

12. The heating, ventilating, and air conditioning system of claim 10, wherein the four-way reheat valve comprises a heat-pump reversing valve.

13. The heating, ventilating, and air conditioning system of claim 10, further comprising a first check valve fluidly coupled to the condenser conduit.

14. The heating, ventilating, and air conditioning system of claim 10, further comprising a plurality of check valves.

15. The heating, ventilating, and air conditioning system of claim 9, wherein the piston valve slide within a main valve chamber is configured to move between a cooling position and a reheat position.

16. The heating, ventilating, and air conditioning system of claim 15, wherein when in the cooling position, the four-way valve fluidly couples the compressor-discharge conduit to the condenser conduit and couples the compressor-suction conduit to the reheat coil intake conduit.

17. The heating, ventilating, and air conditioning system of claim 15, wherein when in the reheat position, the four-way valve fluidly couples the compressor-discharge conduit to the reheat intake conduit and couples the condenser conduit to the compressor-suction conduit.

18. The heating, ventilating, and air conditioning system of claim 9, wherein the flow-restricting device comprises an orifice.

19. The heating, ventilating, and air conditioning system of claim 9, wherein the flow-restricting device comprises an orifice having an orifice opening less than 1/16 of an inch.

20. A method of controlling flow in a heating, ventilating, and air conditioning system, the method comprising: providing a compressor, a reheat coil, and a condenser all fluidly coupled to a closed network having a working fluid; providing a four-way valve fluidly coupled to the closed network, wherein the four-way valve comprises a piston valve slide within a main valve chamber and further comprises a pilot valve fluidly coupled to the main valve chamber for assisting with moving the piston valve slide within the main valve chamber of the four-way valve; extracting fluid from a compressor-suction conduit coupled to the four-way valve and wherein the extraction occurs downstream of the four-way valve and downstream of a flow-restricting device in the compressor-suction conduit; and providing the fluid to the pilot valve to assist with operating the four-way valve, wherein the fluid has a lower pressure than fluid upstream of the flow-restricting device.

* * * * *